United States Patent [19]

Hayes

[11] 4,036,494

[45] July 19, 1977

[54] BASKETBALL GAME DEVICE

[76] Inventor: Thomas H. Hayes, 46 Evergreen Ave., Westport, Conn. 06880

[21] Appl. No.: 689,939

[22] Filed: May 25, 1976

[51] Int. Cl.[2] ..... A63B 63/04

[52] U.S. Cl. ..... 273/1.5 R; 16/171; 16/174; 16/176; 273/105 R

[58] Field of Search ..... 273/1.5 R, 1.5 A, 105 R; 16/171, 174, 176

[56] References Cited

U.S. PATENT DOCUMENTS

| | | | |
|---|---|---|---|
| 129,591 | 7/1872 | Reed | 16/171 UX |
| 898,647 | 9/1908 | Herr | 16/171 |
| 2,889,149 | 6/1959 | Williams | 273/105 R X |
| 3,388,909 | 6/1968 | Woods | 273/1.5 R |
| 3,399,889 | 9/1968 | Harry | 273/1.5 R |
| 3,471,874 | 10/1969 | Dixon | 16/171 X |
| 3,964,743 | 6/1976 | Salsich, Sr. | 273/1.5 R |

*Primary Examiner*—Paul E. Shapiro
*Attorney, Agent, or Firm*—H. Gibner Lehmann; K. Gibner Lehmann

[57] ABSTRACT

A basketball game device especially adapted for use in a room of a home or the like, comprising a backboard assemblage including a central panel part and a pair of wing panel parts, the latter constituting side panels which are hingedly connected to the central panel. A hoop is provided for receiving a simulated basketball in the usual manner. The side panels or wings each carry spring clips which respectively engage two spring-loaded telescoping poles for supporting the assemblage at various adjusted positions in the room between the floor and ceiling thereof. The arrangement is such that the wings can be adjustably positioned to different angles with respect to the central panel part, thereby making the game more interesting by enabling "bank" or angle shots to be made off the wings. In addition, the adjusted angles can be changed merely by laterally shifting either of the poles by the desired amount. A spring action of the telescopic poles also results in a toggle effect, by which the three panels are maintained in either a single flat plane or else with a given angularity as determined by the spacing between the poles.

10 Claims, 10 Drawing Figures

BASKETBALL GAME DEVICE

BACKGROUND

This invention relates generally to basketball game devices and more particularly to portable, accessory-type devices especially adapted for use in homes, etc.

The standard backboard devices commonly employed in conventional basketball games do not lend themselves to indoor use, such as in a home or residence, because of their large physical size and the difficulty encountered in satisfactorily supporting them in a room. In addition, prior devices generally employed a single flat panel which imposes severe limitations on the types of bank shots which could be made from areas other than directly in front of the hoop.

SUMMARY

The present invention adds a new dimension to the game of basketball, and accordingly overcomes some of the drawbacks of prior basketball game devices. The object of the invention is the provision of a novel and improved basketball game device which is simple in construction, lightweight, and which can be secured in place by means of telescopic spring poles extending between the floor and ceiling, thereby enabling it to be readily temporarily installed in a room of a home or residence. A related object is the provision of a device as above, which adds a new variation to the game of basketball by enabling a wider variety of bank shots to be made, from different positions either immediately in front of or else from both sides of the hoop. Still another object of the invention is the provision of an improved game device employing a winged backboard assemblage, wherein the angles which the wings make with respect to the central panel are adjustable to different predetermined positions, thus providing virtually an unlimited variety of different backboard configurations to suit particular installations and accommodate space requirements. A still further object of the invention is to provide an improved winged backboard assemblage with supporting telescopic poles wherein the resilience of the latter provide a toggle effect which enables the panels to be maintained in either a single flat plane or else in an angular disposition, without requiring repositioning of the poles.

The above objects are accomplished by a basketball game device intended for use in a room of a home, comprising a main assemblage including a central panel part with front-mounted hoop, and a pair of wings constituting side panel parts. Means are provided for hingedly connecting the wings to the opposite edges of the central panel part such that they can occupy different angular positions with respect thereto. Demountable means in the form of spring telescopic poles are also provided, adapted for engagement with the floor and ceiling of the room, for supporting the assemblage in an operative position in the room with the wing parts extending from the side edges of the central panel part. The arrangement is such that the wing parts can be set to many different angular positions with respect to the central panel part, thereby providing an unlimited number of different articulated backboard configurations.

Features of the invention reside in the provision of telescopic poles having a degree of resilience, particularly in their smaller diameter members, to provide a yielding or toggle effect which can maintain the panels either flat or in an angular disposition; and the provision of a backboard game device which is especially economical to produce, consists of few parts, is lightweight and sturdy, and capable of extended periods of use in a wide variety of installations.

Other features and advantages will hereinafter appear.

In the drawings, illustrating a preferred embodiment of the invention:

Figure 1:
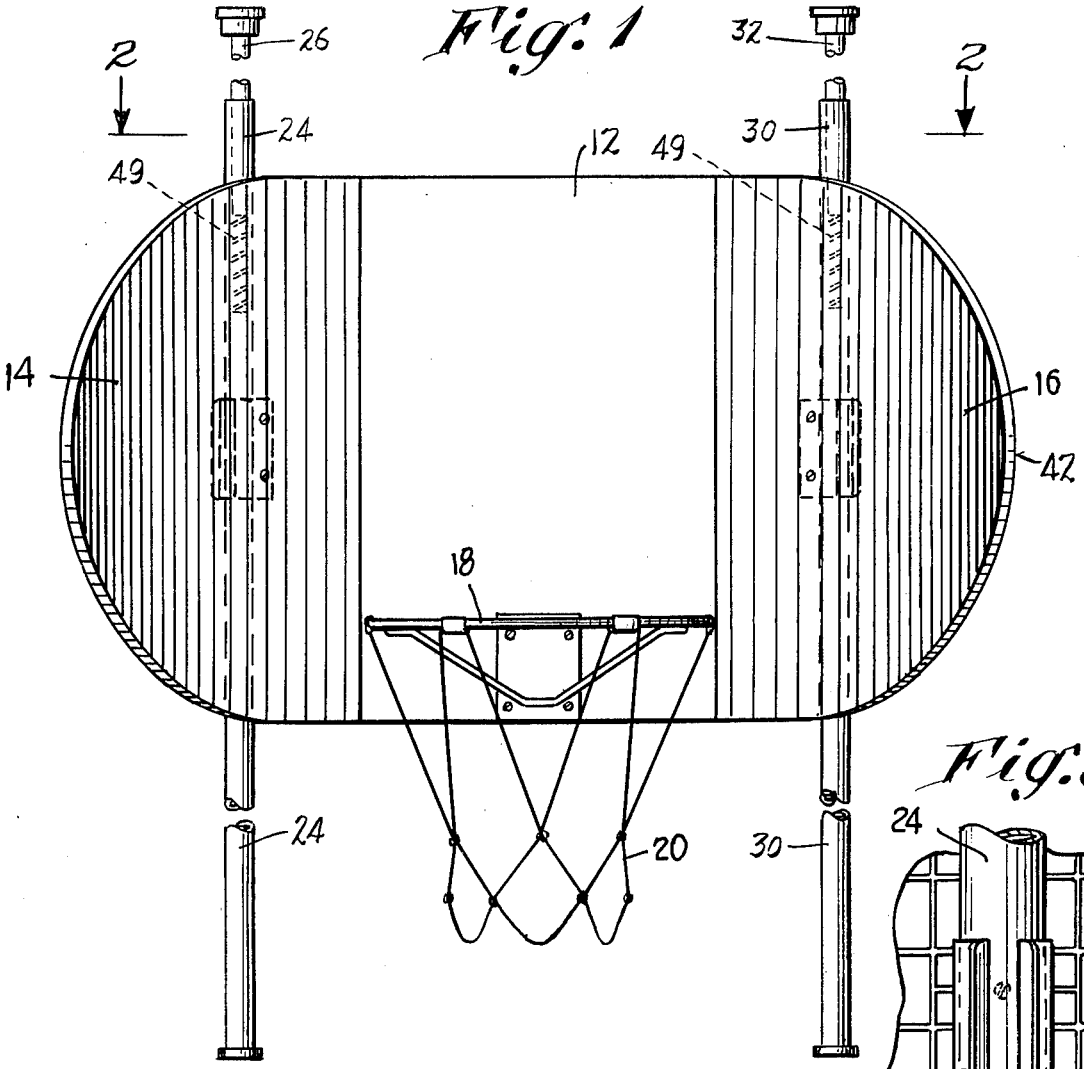
FIG. 1 is a front elevational view of the improved basketball game device of the present invention, including an articulated backboard and including two telescopic supporting poles for mounting the backboard at a predetermined position in a room.
Figure 3:
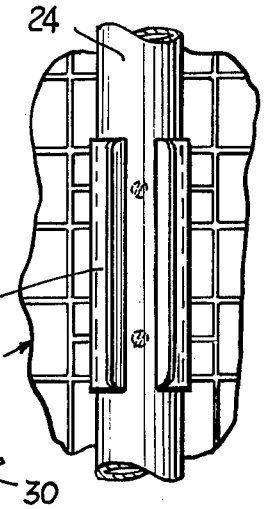
FIG. 3 is a view taken on line 3—3 of FIG. 2.
Figure 2:
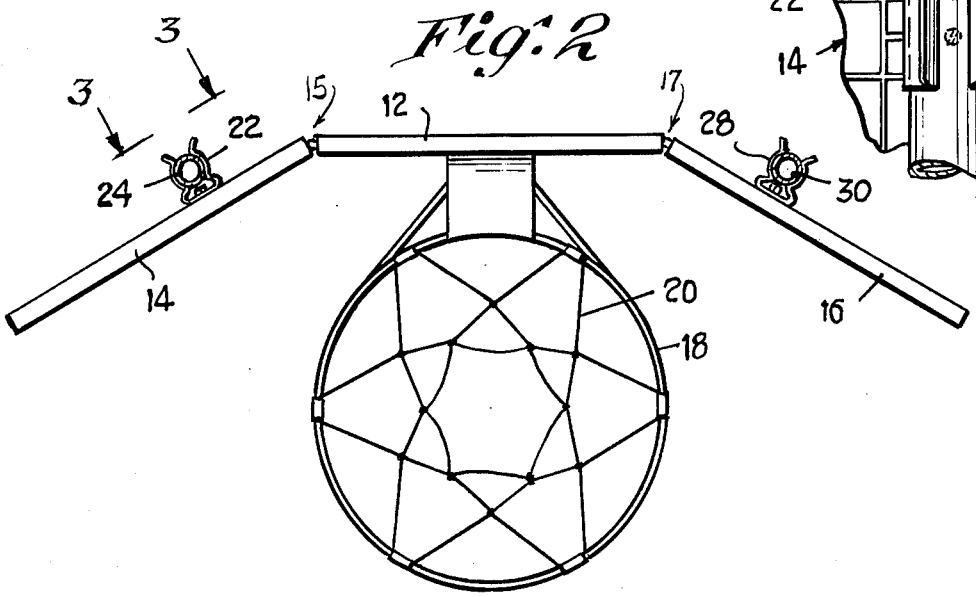
FIG. 2 is a section taken on line 2—2 of FIG. 1.
Figure 5:
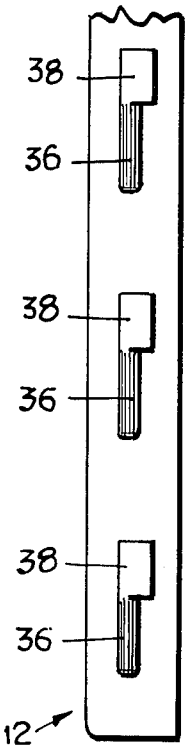
FIG. 5 is a fragmentary left end elevational view of the panel part of FIG. 4.
Figure 4:
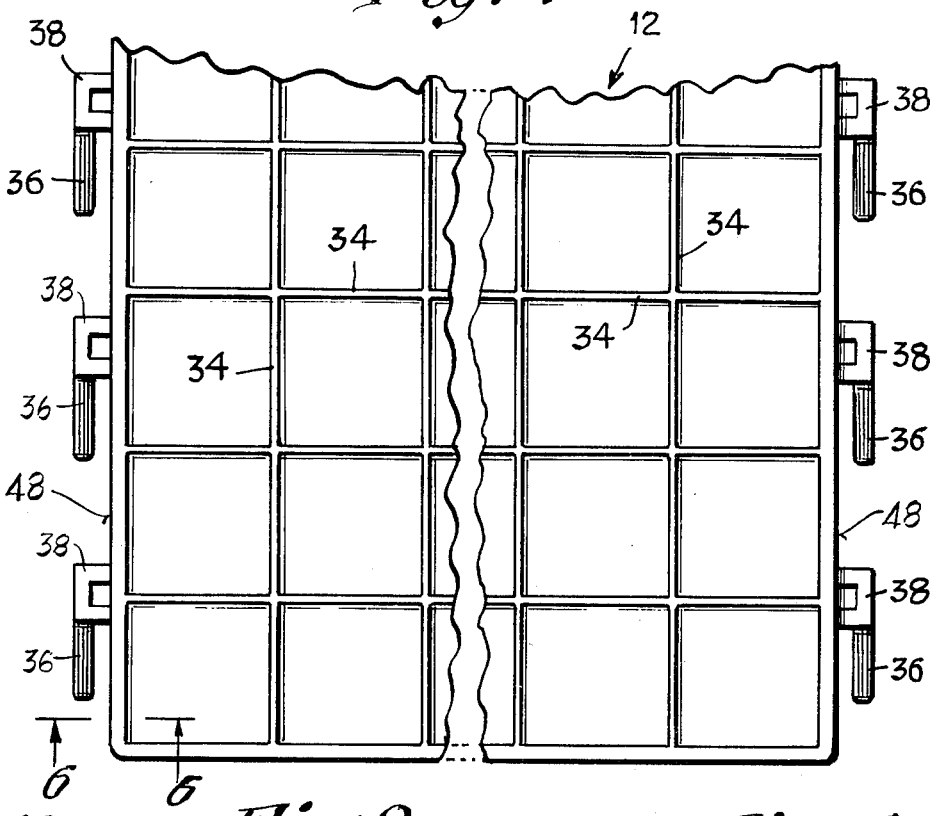
FIG. 4 is a fragmentary rear elevational view of the central panel part of the articulated backboard, particularly showing a series of hinge pins along the opposite vertical longitudinal edges thereof.
Figure 7:
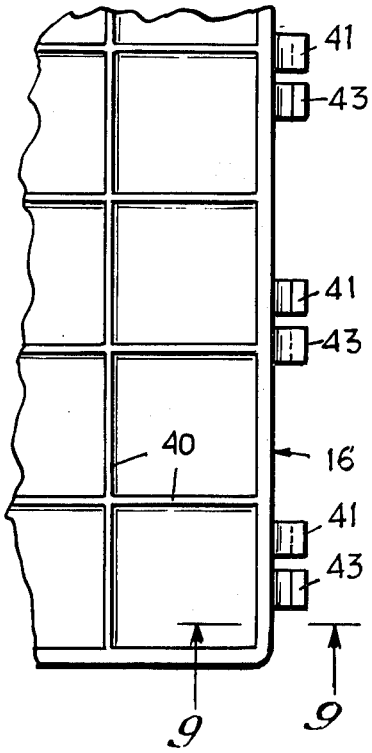
FIG. 7 is a fragmentary rear elevational view of the right-hand wing or side panel of the backboard shown in FIG. 1, and particularly showing two-part sockets for receiving the hinge pins of the central panel part.
Figure 8:
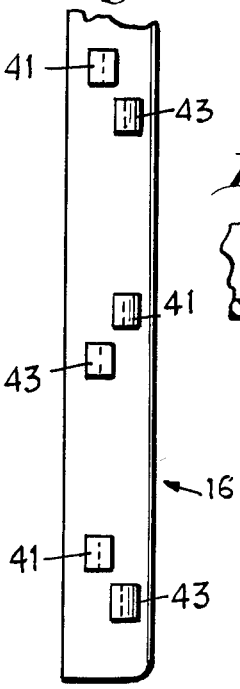
FIG. 8 is a fragmentary side elevational view of the wing of FIG. 7.
Figure 6:
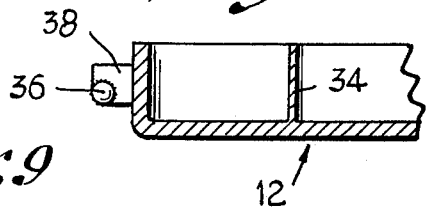
FIG. 6 is a section taken on line 6—6 of FIG. 4.
Figure 9:
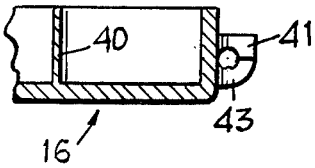
FIG. 9 is a fragmentary section taken on line 9—9 of FIG. 7.

Referring to FIGS. 1 and 2 and in accordance with the present invention there is illustrated a novel and improved basketball game device for use in a room of a home or the like, the device comprising an articulated backboard including a central panel part 12, and left and right wing parts or side panels 14, 16 respectively, which are hingedly connected by unique hinge structures 15 and 17 to the central part and capable of being adjustably positioned to different angular positions. The central panel part 12 carries a hoop 18 and net 20 which are adapted to receive a simulated basketball (not shown) which may be of lightweight foam plastic construction. As particularly shown in FIG. 3, a spring clip 22 is secured to the rear surface of the wing 14, and is bolted in place by suitable screws which are carried in recessed holes in the wing so as to present a flat surface at the front thereof. The clip frictionally holds the outer one of a pair of spring-loaded telescoping poles 24, 26 having enlarged rubber end caps for engagement respectively with the floor and ceiling of the room. In a similar manner, the other wing 16 carries a spring clip 28 which frictionally engages the outer one of a pair of telescoping poles 30, 32 also having rubber end caps for engagement with the floor and ceiling respectively of the room. It will be understood that by such an arrangement, the assemblage consisting of the central panel part 12 and the wings 14, 16 can be slidably adjusted along the two pairs of poles to any desired vertical position in the room, thereby being capable of accommodating a wide variety of room dimensions, and being adaptable to suit the particular age group of players using the game.

The central panel part 12 is particularly illustrated in FIGS. 1, 4, 5 and 6. As shown, it has a plane front surface to which the hoop is secured, and at the back a plurality of vertical and horizontal stiffening ribs 34. The panel 12 is preferably constituted of molded plastic, in which case the ribs 34 are integral with the plane surface of the panel. Extending along the opposite vertical edges of the part 12 is a series of downwardly extending hinge pins or pin members 36 which are carried on molded spacer blocks 38. The pins can have either a perfectly cylindrical configuration, or can be ribbed slightly in order to offer resistance to turning when they are inserted into corresponding sockets of the wings to be described below.

Figure 10:
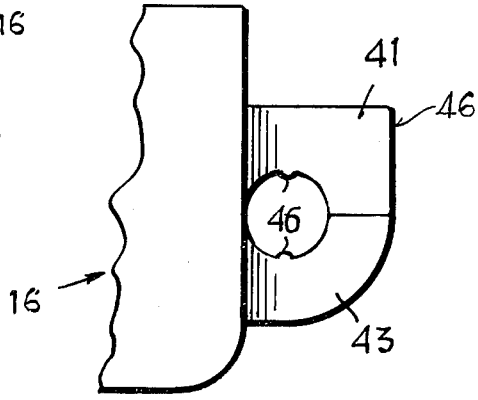
FIG. 10 is an enlargement of the section of FIG. 9, particularly showing interference ribs carried in a socket portion of the wing or side panel.

Referring now to FIGS. 7–10, the wing 16 is seen to include a plane front surface and a plurality of rear stiffening ribs 40 which are molded integral therewith. The wing has a curved edge surface 42 at one side and unique multiple pairs of projections or lug members 41, 43 at its other side, each projection forming a half socket to receive one of the corresponding pins 36 on the adjacent edge of the central panel part. As illustrated in FIG. 10, each projection 41, 43 of the pair can further include an internal interference rib 46 which can cooperate with the ribbed surface of the pins 36 to thereby increase frictional binding between the pins and lug members and hold the wing or side panel 16 in a fixed angular position with respect to the central panel part. With the parts being constituted of plastic, there will be sufficient resiliency in the projections 41, 43 to enable them to be sprung slightly outward and away from one another when the wing is repositioned with respect to the central panel part.

Further in accordance with the invention, one of the projections 41 of each pair includes a restraining stop shoulder 46 which is engageable with a corresponding side edge 48 of the central panel part when the wing is swung to a position which is coplanar with respect thereto. The shoulders 46 thus prevent the wing 16 from swinging toward the rear of the central panel, and add stability to the assemblage in the event that it is desired to form a single planar backboard out of the three panels 12, 14 and 16. In order to maintain such a planar backboard, the pole pairs 24, 26 and 30, 32 may be shifted slightly away from one another, which has the effect of biasing the wings 14, 16 to their extreme open positions wherein they both lie in the plane defined by the central panel part 12. Or a different biasing arrangement involving a toggle action can be employed, as described further below.

It is to be noted that the wings 14 and 16 can be identical with respect to each other, thus reducing the overall fabricating cost of the apparatus by eliminating one of the three molds which would otherwise be required.

In operation, the device of FIG. 1 can be installed between the floor and ceiling of a room by grasping the poles 24, 30 with both hands and forcing them against the ceiling at the desired location, so as to compress the springs 49 which are carried therein. After the poles 24, 30 are released against the floor surface in their proper operative positions, the assemblage consisting of the central panel part 12 and wings 14, 16 can be vertically adjusted to the desired height by sliding the clips 22, 28 along their respective poles. It will be understood that the spacing of the pole pairs 24, 26 and 30, 32 can affect the angle which each wing makes with the central panel part, and accordingly the adjustment of the poles can provide for a wide variety of different backboard configurations, which add greatly to the interest and enjoyment of the game. The angularly disposed surfaces provided by the two wings 14, 16 enable bank shots to be made from a wide variety of positions in the room, as well as from directly in front of the hoop 18. Once in place, the pole pairs 24, 26 and 30, 32 tend to hold the wings 14, 16 in fixed angular positions with respect to the central panel part. Additional stability is provided by the engagement of the interference ribs 46 with the ribbed surfaces of the corresponding pins 36.

An important feature of the invention involves a toggle effect set forth below, and resides in the provision of telescopic spring poles whose entire length, but particularly the small-diameter portions 26, 32 can flex a slight extent so as to yield slightly when the poles are secured in place and laterally stressed apart by the flattened panels. This can be readily accomplished by initially setting up the poles with the panels 12, 14 and 16 in the angular position show in FIG. 2. It will be seen that if the panels should them be flattened so as to all lie in a single flat plane, the above lateral stressing of the poles will occur. Due to the mounting of the poles 24, 26 and 30, 32 at the backs of the panels 14, 16 so as to be spaced from the rear surfaces thereof, in conjunction with the 180° stops 46 of the hinge means between the panels, the laterally stressed poles will maintain the panels in the single flat plane. Or, optionally, the panels can be maintained in the angular disposition of FIG. 2, at the desire of the players, due to the spring toggle action. Thus, it is not necessary to reposition the poles if the game calls for either a flat backboard or else an angular backboard.

The above construction is seen to have the advantage of being light in weight and rugged, as well as being sturdy and capable of prolonged use over extended periods of time. Moreover, installation of the device is readily accomplished without damage to or permanent alteration of the existing facilities. Manufacturing cost can be greatly minimized by the use of a single mold for both wings 14, 16. The device is thus seen to represent a distinct advance and improvement in the field of basketball game devices.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

I claim:

1. A basketball game device intended for use in a room of a home or the like, comprising in combination:

a. a basketball backboard assemblage including a central panel part, a hoop mounted on the front of the central panel part, said hoop being adapted to receive and pass a simulated resilient basketball thrown at said panel part, a pair of wing panel parts constituting side panels, and means hingedly attaching said wing panel parts at opposite side edges of the central panel part, to enable them to occupy different operative angular positions with respect thereto, and b. demountable means adapted for engagement with surfaces of the room for mounting said assemblage in a high operative position in the room with the said wing panel parts extending from the side edges of the central panel part, c. said demountable mounting means comprising two multi-part telescoping poles, the parts of each pole being relatively movable and having means for maintaining their respective engagement with the floor and ceiling of the room.

2. The invention as set forth in claim 1, wherein:
a. one part of one of said poles is fastened to one of said wing panel parts, and
b. a corresponding part of the other of said poles is fastened to the other of said wing panel parts.

3. The invention as set forth in claim 2, wherein:
a. said demountable mounting means further includes pairs of spring clips carried by said wing panel parts respectively, engageable with the associated pole parts,
b. said spring clips being slidable along their respective pole parts to enable vertical positioning of the assemblage in the room.

4. The invention as set forth in claim 1, wherein:
a. said wing attaching means comprises a row of apertured lug members carried by one of said panel parts, and
b. a cooperable row of mating pin members carried by another of said panel parts forming a hinge, enabling the panel parts to have limited adjustable swinging movement with respect to one another.

5. The invention as set forth in claim 4, and further including:
a. interference ribs on one of said members to increase frictional binding between the two, whereby the panel parts can be held in fixed, adjusted turnable positions with respect to one another.

6. The invention as set forth in claim 1, wherein:
a. said wing panel part attaching means includes hinges having restraining stop shoulders for limiting the arcuate movement of the wing panel parts with respect to the central panel part, to an angle no more than 180°.

7. The invention as set forth in claim 1, wherein:
a. said wing panel parts are each constituted of one-piece molded plastic, and each includes integral, molded transverse stiffening ribs on one side thereof.

8. The invention as set forth in claim 7, wherein:
a. the wing panel parts are identical with respect to one another.

9. The invention as set forth in claim 8, wherein:
a. said wing panel part attaching means comprises rows of apertured lug members carried by one of said panel parts,
b. said wing panel part attaching means further including rows of cooperable mating pin members carried by another of said panel parts.

10. The invention as set forth in claim 1, wherein:
a. said poles are resilient and can be flexed laterally,
b. said panel parts being alignable in a single plane,
c. overlapping portions of said poles being spread apart an extent and maintained under lateral stress when the panel parts occupy said single plane, and being relieved of said stress when the panel parts are angularly disposed,
d. said demountable mounting means including fittings which secure the poles to the rear of the wing panel parts in spaced relation thereto,
e. said means hingedly attaching the wing panel parts including means limiting the arcuate movement of the wing panel parts with respect to the central panel part to an angle of substantially no more than 180° wherein the panel parts are aligned in said single plane,
f. the resilient and lateral stressing of the poles thereby providing a toggle effect whereby the panel parts can be held in either a single planar position or in relative angular positions without requiring a shifting of the poles on the floor or ceiling.

* * * * *